US007098756B2

(12) United States Patent
Martikkala et al.

(10) Patent No.: US 7,098,756 B2
(45) Date of Patent: Aug. 29, 2006

(54) ARRANGEMENT AND METHOD FOR COMBINING ELECTRIC SIGNALS

(75) Inventors: Risto Martikkala, Oulu (FI); Jouni Kauhanen, Tampere (FI)

(73) Assignee: Nokia Corporation, Espoo (FI)

( * ) Notice: Subject to any disclaimer, the term of this patent is extended or adjusted under 35 U.S.C. 154(b) by 128 days.

(21) Appl. No.: 10/495,013

(22) PCT Filed: Sep. 17, 2002

(86) PCT No.: PCT/FI02/00738

§ 371 (c)(1),
(2), (4) Date: May 10, 2004

(87) PCT Pub. No.: WO2004/027918

PCT Pub. Date: Apr. 1, 2004

(65) Prior Publication Data

US 2004/0246070 A1 Dec. 9, 2004

(51) Int. Cl.
*H01P 5/12* (2006.01)

(52) U.S. Cl. ..... 333/111; 333/27; 333/160

(58) Field of Classification Search ..... 333/111, 333/160, 27, 161

See application file for complete search history.

(56) References Cited

U.S. PATENT DOCUMENTS 6,320,477 B1 11/2001 Lithgow et al.

FOREIGN PATENT DOCUMENTS

EP 0407226 A2 1/1991

*Primary Examiner*—Robert Pascal
*Assistant Examiner*—Kimberly E Glenn
(74) *Attorney, Agent, or Firm*—Squire, Sanders & Dempsey L.L.P.

(57) ABSTRACT

The invention relates to an arrangement and method for combining electric signals. The arrangement comprises: an antenna element (270) for receiving first electric signals from the environment; a receiver cable (210) in connection with the antenna element (270) for carrying the first electric signals; at least one antenna feeder cable (212) for carrying second electric signals; a transmitting antenna (250) in connection with said at least one antenna feeder cable (212) for transmitting the second electric signals, and at least one cable coupler (120) in said receiver cable (210), in which the polarity of said at least one cable coupler (120) is reversed in order to induce a local leakage current. Said at least one cable coupler (120) is arranged next to said at least one antenna feeder cable (212) for coupling the first electric signals and the second electric signals to the receiver cable (210).

27 Claims, 2 Drawing Sheets

ARRANGEMENT AND METHOD FOR COMBINING ELECTRIC SIGNALS

FIELD

Figure 1:
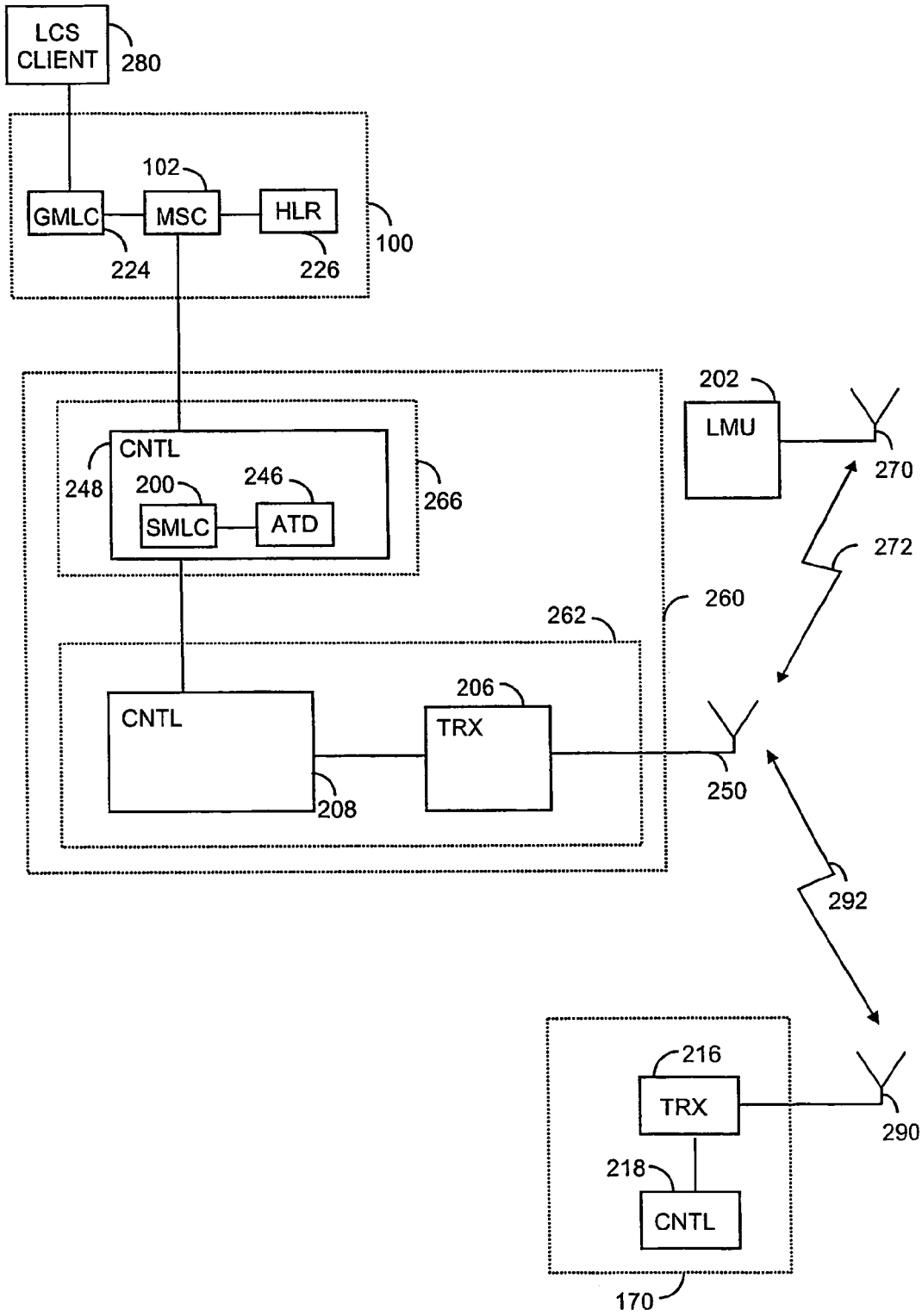

The present invention relates to an arrangement and method for combining electric signals.

BACKGROUND

The received signal quality is important for communications systems. Especially in known location measurement systems, the reference base station signal quality is essential for a location measurement unit (LMU). Location measurement systems are based on measuring base station signals and time delays between them. The greatest problem in these systems is the quality of the measured signals. Multipath propagation presents a problem in terms of signal timing determination reliability in spread-spectrum and GSM environments. Typically, a signal is transmitted from a base station (BTS) and can be reflected from a number of surfaces, such as buildings, mountains or trees. The timing determination is also interfered by for example adjacent channel radio signals.

Different solutions for improving the quality of the received signals have been proposed. One known solution is to combine the reference base station transmitter signal from a base station test connector with a suitable attenuator and a combiner. However, all base stations do not have test connectors. Furthermore, the combiners represent an additional component whose manufacture and installation expenses may grow high. Another existing solution is to take a transmitter signal from a base station transmitter EMP (Electromagnetic Pulse Protector) protector or use additional Directional Coupler. The EMP protector is used to protect the equipment against lightning strikes or high voltages coming down the centre conductor of the antenna line. The use of the EMP protector or additional coupler, however, requires a combiner. Also, shutting off the transmission during installation is necessary. Another solution for improving the signal quality is to move a radio frequency antenna to a better position for good reception of the reference base station. However, that is not always possible due to zoning regulations or physical objects. There are also different solutions of leaking cables, in which the transmitter signal is feeded to tunnels; these solutions would not provide sufficient coupling for the LMU requirements. An ideal solution would be to couple the transmitter signal from the transmitter cable directly to an LMU receiver antenna cable without any changes in the transmitter radio frequency lines.

BRIEF DESCRIPTION OF THE INVENTION

It is an object of the invention to provide an arrangement and a method in such a manner that the above-mentioned problems are solved. This is achieved by an arrangement for combining electric signals, comprising: an antenna element for receiving first electric signals from the environment; a receiver cable in connection with the antenna element for carrying the first electric signals; at least one antenna feeder cable for carrying second electric signals; a transmitting antenna in connection with said at least one antenna feeder cable for transmitting the second electric signals; at least one cable coupler in said receiver cable, in which the polarity of said at least one cable coupler is reversed in order to induce a local leakage current to transfer electromagnetic signals. Said at least one cable coupler, in which the polarity is reversed, is arranged next to said at least one antenna feeder cable for coupling the first electric signals and the second electric signals to the receiver cable.

The invention also relates to a method for combining electric signals, comprising: receiving first electric signals from the environment by an antenna element; carrying the first electric signals by a receiver cable in connection with the antenna element; carrying second electric signals by at least one antenna feeder cable; transmitting the second electric signals by a transmitting antenna in connection with said at least one antenna feeder cable; reversing the polarity of at least one cable coupler in said receiver cable for inducing a local leakage current to transfer electromagnetic signals. The method of the invention comprises arranging said at least one cable coupler, in which the polarity is reversed, next to said at least one antenna feeder cable for coupling the first electric signals and the second electric signals to the receiver cable.

Preferred embodiments of the invention are described in the dependent claims.

The arrangement and method of the invention provide several advantages. In a preferred embodiment of the invention, only a minimum amount of components are needed, for example the use of combiners is not necessary. The problems caused by for instance multipath propagation are avoided. There is no need to make any changes to the transmitter radio frequency lines, which in turn leads to lower cost and simpler installation.

LIST OF THE DRAWINGS

Figure 2:
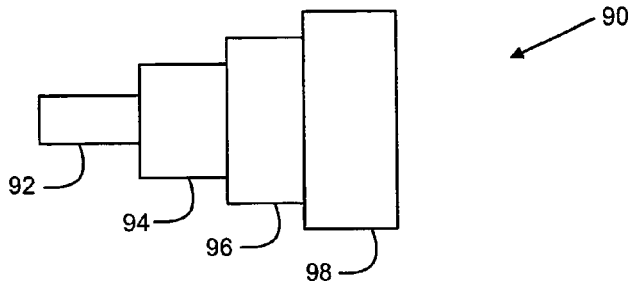
Figure 3:
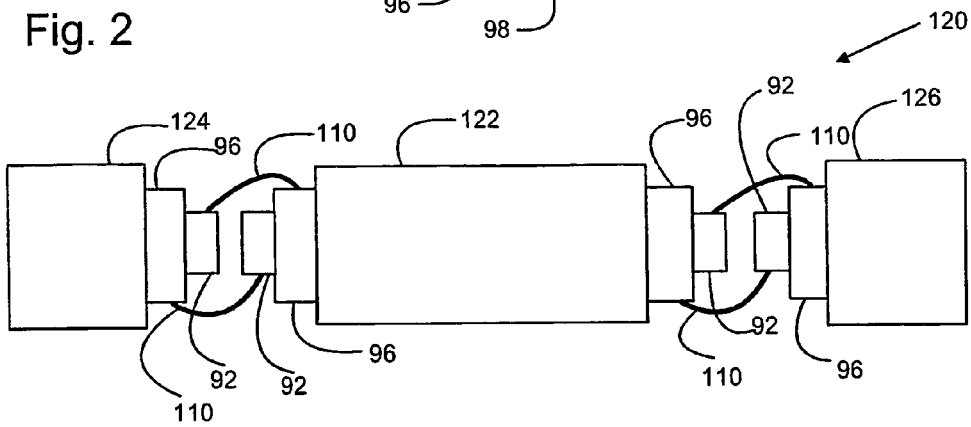
Figure 4:
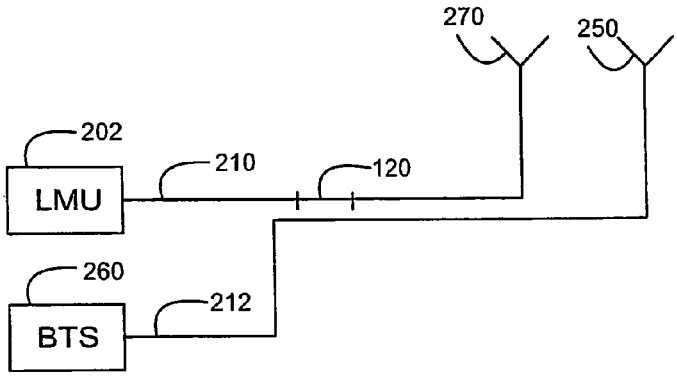
Figure 5:
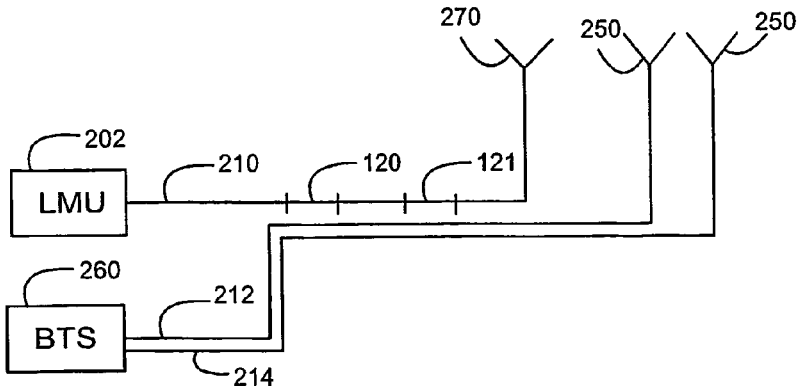

In the following, the invention will be described in greater detail with reference to the preferred embodiments and the accompanying drawings, in which FIG. 1 is a simplified block diagram illustrating an example of the structures of a base station system of a radio system and of a user terminal, FIG. 2 shows a basic structure of a coaxial cable, FIG. 3 shows a cable coupler used in an arrangement according to an embodiment of the invention, FIGS. 4 and 5 illustrate examples of an arrangement according to an embodiment of the invention.

DESCRIPTION OF THE EMBODIMENTS

With reference to FIG. 1, let us examine an example of a radio system to which the preferred embodiments of the invention can be applied.

FIG. 1 is a simplified block diagram which shows the most important parts of a radio system. The structure and functions of the network elements are not described in detail, because they are generally known. The radio system is for example a 2.5-generation GSM (Global System for Mobile communications)/GPRS (General Packet Radio Service) radio system, a second generation GSM radio system or a third generation UMTS (Universal Mobile Telecommunications System) radio system using WCDM (wide band code division multiple access) technique or various combinations thereof.

On a general level, the radio system can be defined to comprise user equipment, which is also known as a subscriber terminal and mobile phone, for instance, and a network part, which comprises the fixed infrastructure of the radio system, i.e. the core network, radio access network and base station system.

In FIG. 1, only one base station 262 is shown, but there can be several bases stations 262 in a typical radio system.

Also, only one base station controller 266 is shown, although in a typical radio system there can be several. The base station system 260 comprises a base station controller (BSC) 266 and a base transceiver station (BTS) 262. The base station controller 266 controls the base transceiver station 262. In principle, the aim is that the devices implementing the radio path and their functions reside in the base transceiver station 262, and control devices reside in the base station controller 266.

The base station controller 266 takes care of the following tasks, for instance: radio resource management of the base transceiver station 262, intercell handovers, frequency control, i.e. frequency allocation to the base transceiver stations 262, management of frequency hopping sequences, time delay measurement on the uplink, implementation of the operation and maintenance interface, and power control.

The base transceiver station 262 contains at least one transceiver which provides one carrier, i.e. eight time slots, i.e. eight physical channels. Typically one base transceiver station 262 serves one cell, but it is also possible to have a solution in which one base transceiver station 262 serves several sectored cells. The diameter of a cell can vary from a few meters to tens of kilometres. The base transceiver station 262 also comprises a transcoder, which converts the speech coding format used in the radio system to that used in the public switched telephone network and vice versa. In practice, the transcoder is, however, physically located in the mobile services switching center 102. The tasks of the base transceiver station 262 include: calculation of timing advance (TA), uplink measurements, channel coding, encryption, decryption, and frequency hopping.

The base station 262 comprises a transmitter-receiver 206, an antenna 250 and a control unit 208. The base station controller 266 also comprises a control unit 248. The user equipment 170 also comprises a standard transmitter-receiver 216 and an antenna 290 for implementing a radiolink 292. The user equipment 170 also comprises a control unit 218. In 2/2.5-generation radio systems, the transmitter-receiver 216 uses a time divisional multiple access technique (TDMA), and for example a normal GMSK modulation (Gaussian Minimum Shift Keying) technique of a GSM system or an EDGE (enhanced data rates for global evolution) modulation, that is, 8-PSK modulation (8 Phase Shift Keying) technique. In a radio system according to WCDMA-systems, the transmitter-receiver 216 uses a WCDMA technique.

SMLC (Serving Mobile Location Center) 200 belongs to localization services and it can be a part of the base station controller 266, located for example in its control unit 248. Alternatively, SMLC 200 is separate equipment connected to the base station controller 266.

The backbone network 100 comprises GMLC (Gateway Mobile Location Center) 224, and HLR (Home Location Register) 226. The main task of GMLC 224 is to provide the localization service in question to an external customer 280 of the localization services. HLR 226 comprises subscriber data and routing information of the localization services.

A location measurement unit (LMU) 202 can be a part of the base station 262, located for instance in the control unit 208 of the base station 262, and it can be implemented as a functionality of the control unit 208 or as separate equipment connected either to the control unit 208 or elsewhere in the base station 262. Alternatively, the location measurement unit 202 is implemented as separate equipment which is connected via its antenna structures 270 and a radio link 272 to the base station. The location measurement unit 202 is located as its own unit separated from the base station 262 and communicates with the base station 262 for example by the radio link 272 in a radio system in FIG. 1.

The user equipment (UE) 170 comprises an antenna 290, with the help of which the transceiver 216 of the user equipment 170 receives signals from the radio path 292. The user equipment (UE) 170 functions are controlled by the control unit 218. In addition to the parts described, the user equipment 170 also comprises a user interface. The user interface typically comprises a loud speaker, a microphone, a display and a keypad, as well as a battery, which are not described in detail.

The controllers 208, 218, 248 control the functions of the equipment and are usually implemented as processors and software, but various hardware solutions are also feasible, for instance a circuit built from logic components or one or more application specific integrated circuits ASIC. A combination of these different implementations is also possible.

One of the base stations of the radio system operates as a reference base station of the location measurement unit, with which a transceiver of the location measurement unit is synchronized. The reference base station is located separate from the location measurement unit. Alternatively, the location measurement unit 202 is located in the base station 262 as in FIG. 1, in which case the reference base station is typically the base station 262, to which the location measurement unit is connected.

The location measurement unit 202 receives signals from the base stations in its localization area. Thus, by receiving signals sent by the base station and the user equipment, it can determine the time delays.

The time delays between the base stations are defined for example by using their real time differences (RTD), which are defined for example using the signals received by the location measurement unit (LMU). Other methods, for example the E-OTD (enhanced observed time difference) method, can also be applied by using absolute time (AT), which is determined in relation to GPS time from a GPS receiver. The GPS receiver is located, for example in the location measurement unit (LMU).

It is common that a cable is used to carry signals between an antenna and a transmitter and/or a receiver. A communications system typically comprises an antenna or a group of antennas. The antenna is operatively coupled to a cable that runs to a transmitter and/or receiver in a transmitter/receiver station.

One of the commonly used cables in the communications industry is a coaxial cable. The coaxial cable is an electrically conducting transmission line, which carries signals to and from different types of circuits. Coaxial cables have an inner conductor and outer conductor, that are separated by a dielectric insulator and externally covered by an outer insulator.

FIG. 2 illustrates the basic structure of a cable, for instance a coaxial cable 90. A typical coaxial cable 90 contains an inner conductor 92, an outer conductor 96 and an insulator 94 between said conductors. The inner conductor 92 carries the signal current and the outer conductor 96 is connected to ground. The insulator 94 or insulating layer can be for instance air, but, in practice, is often for mechanical reasons some insulating material, such as polyethylene, Teflon or the like. FIG. 1 also shows a sheath 98 made for instance of polyethylene for protecting the coaxial cable 90 against wearing.

In FIG. 3 a cable coupler 120 is shown used in an arrangement according to the invention. The cable coupler 120, such as a coaxial cable, in FIG. 3 comprises two cable connectors 124, 126 and a centre part 122 there between.

Inside the centre part 122 and the cable connectors 124, 126 there are inner conductors 92, around which dielectric materials (not shown) are disposed. There also are outer conductors 96 around the dielectric material. The cable coupler 120 is so arranged that the inner conductors 92 of the cable connectors 124, 126 are connected to the outer conductors 96 of the centre part 122 and the outer conductors 96 of the cable connectors 124, 126 are connected to the inner conductors 92 of the centre part 122.

Thus, the polarity of the cable coupler 120 becomes reversed. The polarity change induces a leakage current to and from the cable coupler 120, and electromagnetic signals are carried through it. The two cable connectors 124, 126 are for example a male plug and/or a female plug in order to provide a connection to a suitable mating component, such as to another cable. By connecting the cable coupler 120 from both its cable connectors 124, 126 to another cable, a local radiating and receiving element in the form of the cable coupler 120 is achieved. If there is no need to carry other signals, for instance from an antenna, through the cable coupler 120, then one of the two cable connectors 124, 126 is terminated with a load.

The connections 110 between the inner conductors 92 and the outer conductors 96 are preferably arranged so as to have the shortest wavelength possible for providing maximum frequency range in the cable coupler 120. The polarity change is therefore made as short as possible in the connections 110, in a manner known per se, for instance by special clips, reflow soldering or microwelding. The thickness of the connection 110 preferably changes gradually.

FIG. 4 illustrates an example of the arrangement according to the invention. In FIG. 4, there is a location measurement unit 202, a receiver cable 210 and an antenna element 270. The antenna element 270 receives electric signals from the environment and the receiver cable 210 carries the electric signals received by the antenna element 270 to the location measurement unit 202. In FIG. 4, there is also a base station 260, such as a reference base station of a communications system, an antenna feeder cable 212, a cable coupler 120 in the receiver cable 210 and a transmitting antenna 250. The base station 260 transmits electric signals to the location measurement unit 202. The electric signals transmitted by the base station 260 are carried in the antenna feeder cable 212 and transmitted by the transmitting antenna 250. In the receiver cable 210 there is, according to the invention, a cable coupler 120, as described in FIG. 3, in which the polarity of the cable coupler 120 is reversed in order to induce a local leakage current to receive the electromagnetic signals leaking from the antenna feeder cable 212 and to combine them with the signals carried in the receiver cable 210. The length of the cable coupler 120 is determined so as to achieve the lowest frequency wavelength and to enable the arranging of the cable coupler 120 close to one or more antenna feeder cables 212. The cable coupler 120, such as a short antenna cable, is for example between 30 to 60 centimeters long in present GSM systems due to the used frequency range in the GSM systems.

The cable coupler 120 is arranged next to the antenna feeder cable 212. The cable coupler 120 is for example on top of the antenna feeder cable 212 or at a predetermined distance from the antenna feeder cable 212. The distance between the cable coupler 120 and the antenna feeder cable 212 can be changed according to different circumstances in the environment. The predetermined distance between the cable coupler 120 and the antenna feeder cable 212 is for example based on a desired gain of the electric signals leaking off the antenna feeder cable 212 to the cable coupler 120. The cable coupler 120 can also be twisted around the antenna feeder cable 212.

The objective of the arrangement illustrated in FIG. 4 is to combine to the receiver cable 210 the second electric signals carried in the antenna feeder cable 212 and the first electric signals carried in the receiver cable 210. This is achieved by an arrangement described above, in which the cable coupler 120 is arranged next to the antenna feeder cable 212 for coupling the second electric signals to the receiver cable 210. The second electric signals carried in the antenna feeder cable 212 are thus, with the help of the cable coupler 120, which acts as a coupler element, combined to the first electric signals carried in the receiver cable 210. With the exemplary arrangement mentioned, the electric signals transmitted from the base station 260 are transferred free of interference and the location measurement unit 202 is able to receive accurate data from the base station 260, which acts as a reference base station to the location measurement unit 260.

FIG. 5 illustrates another example of the arrangement according to the invention. As in the example of FIG. 4, in FIG. 5, there is a location measurement unit 202, a receiver cable 210, an antenna element 270, a base station 260, an antenna feeder cable 212, a cable coupler 120 and transmitting antennas 250. Additionally, the cable coupler 120 may be fitted close to multiple antenna feeder cables 212, 214 for combining all the signals carried in the antenna feeder cables 212, 214. It is also possible to have several cable couplers 120, 121 connected in series for combining signals from multiple antenna feeder cables 212, 214 in the arrangement.

As in the arrangement illustrated in FIG. 4, in the arrangement illustrated in FIG. 5, the cable couplers 120, 121, in which the polarity of the cable couplers 120, 121 is reversed, are inducing a local leakage current for the receiver cable 210 sensitive to receive the electric signals leaked to the surface of the antenna feeder cables 212, 214. As a result, the electric signals carried in the receiver cable 210 and the electric signals carried in both of the antenna feeder cables 212, 214 are coupled to the receiver cable 210.

Even though the invention is described above with reference to the examples according to the accompanying drawings, it is clear that the invention is not restricted thereto but it can be modified in several ways within the scope of the appended claims.

The invention claimed is:

1. An arrangement for combining electric signals, comprising:

an antenna element for receiving first electric signals from the environment;

a receiver cable in connection with the antenna element for carrying the first electric signals;

at least one antenna feeder cable for carrying second electric signals;

a transmitting antenna in connection with said at least one antenna feeder cable for transmitting the second electric signals;

at least one cable coupler in said receiver cable, in which the polarity of said at least one cable coupler is reversed in order to induce a local leakage current to transfer electromagnetic signals, wherein said at least one cable coupler, in which the polarity is reversed, is arranged next to said at least one antenna feeder cable for coupling the first electric signals and the second electric signals to the receiver cable.

2. The arrangement of claim 1, wherein said at least one cable coupler comprises: a centre part; two cable connectors at the opposite ends of the centre part; inner conductors inside the centre part and the cable connectors; dielectric materials disposed around the inner conductors; outer conductors disposed around the dielectric materials; the inner conductors of the cable connectors being connected to the outer conductors of the centre part and the outer conductors of the cable connectors being connected to the inner conductors of the centre part.

3. The arrangement of claim 2, wherein said at least one cable coupler is connected to said receiver cable with both cable connectors.

4. The arrangement of claim 2, wherein the connections between the inner conductors and the outer conductors are arranged so as to have the shortest wavelength possible for providing maximum frequency range in said at least one cable coupler.

5. The arrangement of claim 2, wherein said centre part is a short antenna element.

6. The arrangement of claim 1, wherein said at least one cable coupler is arranged next to said at least one antenna feeder cable with a cable tie.

7. The arrangement of claim 1, wherein the receiver cable is arranged to carry a combination of the first and second electric signals to a location measurement unit (LMU) of a communications system.

8. The arrangement of claim 7, wherein said at least one cable coupler is arranged to carry electric signals from a base station, transmitted signals of which the location measurement unit is arranged to measure.

9. The arrangement of claim 8, wherein the base station is a reference base station of the communications system.

10. The arrangement of claim 1, wherein said at least one cable coupler is arranged in a series connection with the receiver cable.

11. The arrangement of claim 1, wherein said at least one cable coupler is terminated with a load.

12. The arrangement of claim 1, wherein said at least one cable coupler is twisted around said at least one antenna feeder cable.

13. The arrangement of claim 1, wherein said at least one cable coupler is arranged to transfer the lowest frequency wavelength.

14. The arrangement of claim 1, wherein said at least one cable coupler is arranged next to said at least one antenna feeder cable at a predetermined distance.

15. The arrangement of claim 14, wherein the predetermined distance between said at least one cable coupler and said at least one antenna feeder cable is determined based on the desired gain of the second electric signal.

16. A method for combining electric signals, comprising:

receiving first electric signals from the environment by an antenna element;

carrying the first electric signals by a receiver cable in connection with the antenna element;

carrying second electric signals by at least one antenna feeder cable;

transmitting the second electric signals by a transmitting antenna in connection with said at least one antenna feeder cable;

reversing the polarity of at least one cable coupler in said receiver cable for inducing a local leakage current to transfer electromagnetic signals, the method further comprising arranging said at least one cable coupler, in which the polarity is reversed, next to said at least one antenna feeder cable for coupling the first electric signals and the second electric signals to the receiver cable.

17. The method of claim 16, the method further comprising providing at least one cable coupler with a centre part; two cable connectors at the opposite ends of the centre part; inner conductors inside the centre part and the cable connectors; dielectric materials disposed around the inner conductors; outer conductors disposed around the dielectric materials; the method further comprising connecting the inner conductors of the cable connectors to the conductors of the centre part and connecting the outer conductors of the cable connectors to the inner conductors of the centre part.

18. The method of claim 17, the method further comprising connecting said at least one cable coupler to said receiver cable with both cable connectors.

19. The method of claim 17, the method further comprising arranging the connections between the inner conductors and the outer conductors so as to have the shortest wavelength possible for providing maximum frequency range in said at least one cable coupler.

20. The method of claim 16, the method further comprising arranging said at least one cable coupler next to said at least one antenna feeder cable with a cable tie.

21. The method of claim 16, the method further comprising arranging the receiver cable to carry a combination of the first and second electric signals to a location measurement unit (LMU) of a communications system.

22. The method of claim 21, the method further comprising carrying electric signals from a base station, transmitted signals of which the location measurement unit is arranged to measure, by said at least one cable coupler.

23. The method of claim 16, the method further comprising arranging said at least one cable coupler in a series connection with the receiver cable.

24. The method of claim 16, the method further comprising terminating said at least one cable coupler with a load.

25. The method of claim 16, the method further comprising twisting said at least one cable coupler around said at least one antenna feeder cable.

26. The method of claim 16, the method further comprising arranging said at least one cable coupler next to said at least one antenna feeder cable at a predetermined distance.

27. The method of claim 26, the method further comprising determining the predetermined distance between said at least one cable coupler and said at least one antenna feeder cable based on the desired gain of the second electric signal.

* * * * *